US007756276B2

(12) United States Patent
Hersbach et al.

(10) Patent No.: US 7,756,276 B2
(45) Date of Patent: Jul. 13, 2010

(54) AUDIO AMPLIFICATION APPARATUS

(75) Inventors: Adam Hersbach, The Patch (AU); Hugh McDermott, Mt. Macedon (AU); Andrea Simpson, Yarraville (AU)

(73) Assignee: Phonak AG, Stafa (CH)

( * ) Notice: Subject to any disclaimer, the term of this patent is extended or adjusted under 35 U.S.C. 154(b) by 1094 days.

(21) Appl. No.: 11/087,946

(22) Filed: Mar. 23, 2005

(65) Prior Publication Data

US 2005/0226427 A1 Oct. 13, 2005

(30) Foreign Application Priority Data

Apr. 1, 2004 (AU) ..... 2004201374

(51) Int. Cl.
*H04R 29/00* (2006.01)
*H04R 25/00* (2006.01)

(52) U.S. Cl. ..... 381/60; 381/316; 381/321; 381/23.1

(58) Field of Classification Search ..... 381/56, 381/59, 60, 312, 316, 318, 320, 321, 23.1, 381/83, 93, 95, 96, 98; 600/559; 73/585
See application file for complete search history.

(56) References Cited

U.S. PATENT DOCUMENTS 3,894,195 A 7/1975 Kryter
4,118,604 A * 10/1978 Yanick ..... 381/320
4,731,850 A 3/1988 Levitt et al.
4,783,818 A 11/1988 Graupe et al.
4,803,732 A * 2/1989 Dillon ..... 381/320
4,815,140 A 3/1989 Wagner
4,845,757 A 7/1989 Wagner
4,879,749 A 11/1989 Levitt et al.
5,091,952 A 2/1992 Williamson et al.
5,259,033 A 11/1993 Goodings et al.
5,412,734 A 5/1995 Thomasson
5,621,802 A 4/1997 Harjani et al.
5,649,019 A 7/1997 Thomasson (Continued)

FOREIGN PATENT DOCUMENTS

AU 2002300314 7/2002

(Continued)

OTHER PUBLICATIONS

Bustamante, Diane K., Worall, T. L., Willamson, M.J. "Measurement and Adaptive Suppression of Acoustic Feedback in Hearing Aids," Nicolet instruments, Audiodiagnostics Division, Madison, Wisconsin, CH2673-2/89/0000-2017, IEEE, 2017-2020.

(Continued)

*Primary Examiner*—Xu Mei
(74) *Attorney, Agent, or Firm*—Pearne & Gordon LLP

(57) ABSTRACT

A method of adjusting frequency-dependent amplification in an audio amplification apparatus. The audio amplification apparatus includes a forward transfer path (2) connectable to an output transducer, the forward transfer path including a frequency transposing element. The method includes the steps of: presenting stimuli to the output transducer at a plurality of frequencies; adjusting the stimulus level (C) at each frequency to meet a predefined loudness perception level or detection threshold of the listener; deriving an equal loudness contour of output transducer levels from the adjusted stimuli levels; and deriving the frequency-dependent amplification of levels of input signals (I) at each frequency.

25 Claims, 7 Drawing Sheets

U.S. PATENT DOCUMENTS

| | | | | |
|---|---|---|---|---|
| 5,680,467 | A | 10/1997 | Hansen | |
| 5,937,377 | A * | 8/1999 | Hardiman et al. | 704/225 |
| 6,072,884 | A | 6/2000 | Kates | |
| 6,104,822 | A * | 8/2000 | Melanson et al. | 381/320 |
| 6,201,875 | B1 | 3/2001 | Davis et al. | |
| 6,252,967 | B1 | 6/2001 | Moore et al. | |
| 6,327,366 | B1 * | 12/2001 | Uvacek et al. | 381/60 |
| 6,347,148 | B1 | 2/2002 | Brennan et al. | |
| 6,404,895 | B1 | 6/2002 | Weidner | |
| 6,434,246 | B1 | 8/2002 | Kates et al. | |
| 6,434,247 | B1 | 8/2002 | Kates et al. | |
| 6,498,858 | B2 | 12/2002 | Kates | |
| 6,574,342 | B1 * | 6/2003 | Davis et al. | 381/314 |
| 6,731,767 | B1 * | 5/2004 | Blamey et al. | 381/312 |
| 6,912,289 | B2 * | 6/2005 | Vonlanthen et al. | 381/312 |
| 7,194,100 | B2 * | 3/2007 | Kuhnel et al. | 381/321 |
| 2002/0076072 | A1 | 6/2002 | Cornelisse | |
| 2003/0002699 | A1 * | 1/2003 | Schulz et al. | 381/316 |
| 2003/0053647 | A1 | 3/2003 | Kates | |
| 2007/0223752 | A1 * | 9/2007 | Boretzki et al. | 381/312 |

FOREIGN PATENT DOCUMENTS

| | | | |
|---|---|---|---|
| AU | 2003236382 | | 8/2003 |
| EP | 0 585 976 | A2 | 3/1994 |
| EP | 0 930 801 | A2 | 1/1998 |
| JP | 2000354292 | A | 12/2000 |
| WO | 00/19605 | | 4/2000 |
| WO | 00/21332 | | 4/2000 |
| WO | 01/06746 | | 1/2001 |
| WO | 01/06812 | A1 | 1/2001 |
| WO | 01/54452 | A1 | 1/2001 |
| WO | 01/22775 | A2 | 3/2001 |
| WO | 02/25996 | A1 | 3/2002 |

OTHER PUBLICATIONS

Chi, Hsiang-Feng, Gao, S.X. and Soli, S. D. "A Novel Approach of Adaptive Feedback Cancellation for Hearing Aids," House Ear Institute, Los Angeles, Department of Electrical Engineering, University of California, Los Angeles, 0-7803-5471-0/99 IEEE, III-195-198.

Estermann, Pius, Kaelin, August, "Feedback Cancellation in Hearing Aids: Results From Using Frequency-Domain Adaptive Filters," Institute for Signal and Information Processing Swiss Federal Institute of Technology Zurich, Switzerland; Institute of Signal and Information Processing, Swiss Federal Institute of Technology, Zurich, Switzerland, 257-260.

Hellgren, Johan, "Analysis of Feedback Cancellation in Hearing Aids With Filtered-X LMS and the Direct Method of Closed Loop Identification," IEEE Transactions of Speech and Audio Processing, vol. 10, No. 2, Feb. 2002. 119-131.

Kaelin, August, Lindgren, A., Wyrsch, S. "A Digital Frequency-Domain Implementation of a Very High Gain Hearing Aid With Compensation for Recruitment of Loudness and Acoustic Echo Cancellation" Signal Processing, Swiss Federal Institute of Technology (ETH), Signal and Information Processing Laboratory, CH-8092 Zurich, Switzerland, Department of Electrical Engineering, University of Rhode Island, Kingston, RI 02881, USA. 71-85.

Kates, James M. "Feedback Cancellation in Hearing Aids: Results From a Computer Simulation," IEE Transactions On Signal Processing vol. 39, No. 3, Mar. 1991, 553-562.

Kates, James M. "Feedback Cancellation in Hearing Aids," Center for Research in the Speech and Hearing Sciences, City University of New York, Graduate Center, CH-2847-2/90/0000-1125 IEEE.

Kates, James M. "Constrained Adaptation for Feedback Cancellation in Hearing Aids" J. Acoust Soc. Am 106 (2) Aug. 1999, 1010-1019.

Kates, James M. "Feedback Cancellation in Hearing Aids Using Constrained Adaptation" Audio Logic, Proc. 1999 IEEE Workshop on Applications of Signal Processing to Audio and Acoustics, 231-234.

Knecht, Wolfgang G "Some Notes on Feedback Suppression With Adaptive Filters in Hearing Aids" Phonak AG.

Maxwell, Joseph A. and Patrick M. Zurich, Reducing Acoustic Feedback in Hearing Aids IEEE Transactions on Speech and Audio Processing, vol. 3. No. 4, Jul. 1995, 304-313.

Young-cheol Park, Dong-wook Kim, In-young Kim. "An Efficient Feedback Cancellation for Multiband Compression Hearing Aids," Biomedical Engineering Team, Samsung Advanced Institute of Technology, 0-7803-5164-Sep. 1998, 2706-2709.

M.G. Siqueira, R. Speece, E. Petsalis, A. Alwan. "Subband Adaptive Filtering Applied to Acoustic Feedback Reduction in Hearing Aids," Department of Electrical Engineering, University of California, Los Angeles, 1058-6393/97 IEEE, 788-792.

Rongtai Wang and Ramesh Harjani, "Acoustic Feedback Cancellation in Hearing Aids," Department of Electrical Engineering, University of Minnesota. 0-7803-0949-Apr. 1993, 1993 IEEE, I-137-I-140.

Brian D. Woodruff and David A Preves, "Fixed Filter Implementation of Feedback Cancellation for In-The-Ear Hearing Aids," Argosy Electronics, Inc.

Sigisbert Wyrsc and August Kaelin, "Adaptive Feedback Cancelling in Subbands for Hearing Aids," Swiss Federal Institute of Technology (ETH), Signal and Information Processing Laboratory. 0-7803-5041-Mar. 1999, IEEE, 921-924.

M.R. Schroeder, "Improvement of Acoustic-Feedback Stability by Frequency Shifting" The Journal of the Acoustical Society of America, vol. 9, Sep. 1964.

Jeremy Agnew, Ph.D. "Acoustic Feedback and Other Audible Artifacts in Hearing Aids," Trends in Amplification, vol. 1, No. 2, 1996.

Sigisbert Wyrsch and August Kaelin, "Subband Signal Processing for Hearing Aids." Swiss Federal Institute of Technology (ETH), Signal and Information Processing Laboratory. 0-7803-5471-0/99, 1999 IEEE.

European Office action for Application No. 2004201374 dated Mar. 10, 2009.

* cited by examiner

AUDIO AMPLIFICATION APPARATUS

The present invention relates generally to the audio amplification apparatus for processing sound signals, and in particular to a procedure for fitting of audio amplification apparatus for use by a listener. The present invention is suitable for adjusting audio amplification apparatus such as hearing aids, and it will be convenient to describe the invention in relation to that exemplary, non-limiting application.

A theoretical model 1 of a hearing aid is shown in FIG. 1. An external signal received by the hearing aid is amplified along a forward transfer path 2 to provide a signal to an output transducer. The hearing aid amplifier has a forward transfer function H. Feedback in the hearing aid occurs when the acoustic signal from the output transducer finds its way back to the input transducer of the amplifier. A feedback path 3 is shown and includes a transfer function G of all combined feedback paths. The feedback signal is added to the forward transfer path 2 in the theoretical model 1 by a summation device 4.

In hearing aids and like audio amplifiers conforming to this model, feedback can result in audible whistling or howling. Under these conditions, the closed loop gain of the amplifier is unstable and approaches infinity at the frequency where certain phase and gain requirements are met. In order to address this problem, a variety of feedback suppression systems have been proposed.

In one such system, a frequency transposition element is introduced into the audio amplifier to shift the frequency of the input sound signal either upwardly or downwardly, in addition to amplifying the signal, before sending it to the output transducer. One such frequency transposing amplifier is described in pending Australian Patent Application No. 2002300314, 29 Jul. 2002. The manner in which the frequency transposing amplifier operates is illustrated by the theoretical model 5 shown in FIG. 2. In this model, a frequency transposing element 6 has been added to the forward transfer path 2 of the audio amplifier. The frequency of the amplified external signal is transposed to a difference frequency. The output, and hence the feedback signal, is at a different frequency from that of the external input signal so that successive summation of a signal at the microphone input at a particular frequency cannot occur. The introduction of such a frequency shifting component can make the closed loop gain of the system stable and avoid spontaneous oscillation under certain conditions.

Whilst a frequency transposing amplifier may be stable in terms of its closed loop gain, the amplifier output may be increased to a level which causes unwanted artefacts. Such artefacts are introduced when the output of the amplifier is at a sufficiently high level so that attenuation of the signal via the feedback path results in a feedback signal of sufficiently high level to cause distortion when added to the incoming signal. A feedback suppression amplifier that addresses this problem is described in co-pending Australian Patent Application No 2003236382, filed 20 Aug. 2003. The feedback suppression system described in that co-pending patent application acts to remove or compensate for the presence of feedback signals at transposed frequencies in the closed loop system shown in FIG. 2.

In that feedback suppression system, the presence of an undesired feedback signal component resulting from the amplification and frequency transposition of an input sound signal is predicted, and a correction applied to the output signal at each of the transposed frequencies to compensate for the presence of the undesired feedback signal component if the output signal level is greater than a predetermined activation level. The present application should be read in conjunction with Australian Patent Application No 2003236382, the contents of which are incorporated herein by reference.

The frequency-dependent amplification of any hearing aid, including frequency transposing hearing aids, needs to be adjusted to suit each individual wearer's hearing loss. The fitting procedure required to make such adjustments is a time consuming and often inaccurate process, requiring multiple attempts before the hearing aid is adjusted to suit each individual's needs. In particular, it is difficult to adjust the frequency dependent amplification of a hearing aid so that input signals having levels similar to the average level of speech signals are amplified such that they are perceived as equally loud across a range of frequencies by the hearing aid wearer.

Moreover, in hearing aids using selectively operable feedback suppression systems, the calculation of the activation levels to determine when output signal correction is required is frequency dependent, and is affected by the characteristics of the acoustic feedback path of the hearing aid when it is worn by a user. Once again, the determination of suitable activation levels is a difficult and time consuming task, and may require several attempts to achieve a result acceptable to a hearing aid user.

It would be desirable to provide a method of adjusting an audio amplification apparatus such as a hearing aid in a manner that ameliorates or overcomes one or more disadvantages of known hearing aid adjustment techniques.

It would also be desirable to provide a method of adjusting frequency dependency amplification in an audio amplification apparatus that ameliorates or overcomes one or more known disadvantages of the prior art.

It would furthermore be desirable to provide a method of determining activation levels for feedback suppression in an audio amplification apparatus that ameliorates or overcomes one or more disadvantages of the prior art.

One aspect of the present invention provides a method of adjusting frequency-dependent amplification in an audio amplification apparatus, the audio amplification apparatus including:

a forward transfer path connectable to an output transducer, the forward transfer path including a frequency transposing element; the method including the steps of:

presenting stimuli to the output transducer at a plurality of frequencies;

adjusting the stimulus level at each frequency to meet a predefined loudness perception level or detection threshold of the listener;

deriving an equal loudness contour of output transducer levels from the adjusted stimuli levels; and deriving the frequency-dependent amplification of input signals at each frequency from the equal loudness contour at the corresponding transposed frequencies.

Preferably, the frequency-dependent amplification at each frequency is derived by subtracting the magnitude of a standardised input signal component at that frequency from the magnitude of the stimulus level at a transposed frequency. For example, the magnitude of the input signal component at each frequency may be the level of international long-term average speech spectrum (ILTASS) at an overall level of 70 dB SPL at that frequency.

In a preferred embodiment of the invention, the stimuli are applied directly to the output transducer.

The predefined loudness perception level of the listener may be selected from the group of: very soft, soft, comfortable but slightly soft, comfortable, comfortable but slightly loud, loud but OK, uncomfortably loud and extremely uncomfortable. In one embodiment, the predefined loudness perception of the listener level is comfortable but slightly soft.

The predefined loudness perception level of the listener may be determined by:

the listener choosing a descriptor of the stimulus level at each frequency; and adjusting the stimulus level until the chosen descriptor meets the predefined loudness perception level of the listener.

Alternatively, the predefined loudness perception level of the listener may be determined by:

presenting a reference stimulus to the output transducer at one of the plurality of frequencies, the stimulus level meeting the predefined loudness perception level of the listener;

presenting stimuli to the output transducer at the other frequencies; and adjusting the stimulus level at the other frequencies to match the listener's loudness perception level to that of the reference stimulus.

Another aspect of the invention provides a method of adjusting frequency-dependent amplification in an audio amplification apparatus, the audio amplification apparatus including:

a forward transfer path connectable to an output transducer, the forward transfer path including a frequency transposing element; and a feedback path adding a feedback signal to the forward transfer path, the feedback path being disconnected from the forward transfer path during fitting; the method including the steps of:

applying a standardised input signal to the forward transfer path so as to apply stimuli to the output transducer at a plurality of frequencies; and adjusting the frequency-dependent amplification at each frequency so that the stimulus level meets a predefined loudness perception level or detection threshold of the listener.

The magnitude of the input signal component at each frequency may be the level of international long-term average speech spectrum (ILTASS) at an overall level of 70 dB SPL at that frequency.

The predefined loudness perception level of the listener may be selected from the group of: very soft, soft, comfortable but slightly soft, comfortable, comfortable but slightly loud, loud but OK, uncomfortably loud and extremely uncomfortable. Preferably, the predefined loudness perception of the listener level is comfortable but slightly soft.

The predefined loudness perception level of the listener may be determined by:

the listener choosing a descriptor of the stimulus level at each frequency; and adjusting the stimulus level until the chosen descriptor meets the predefined loudness perception level of the listener.

The predefined loudness perception level of the listener may be determined by:

presenting a reference stimulus to the output transducer at one of the plurality of frequencies, the stimulus level meeting the predefined loudness perception level of the listener;

presenting stimuli to the output transducer at the other frequencies; and adjusting the stimulus level at the other frequencies to match the listener's loudness perception level to that of the reference stimulus.

Yet another aspect of the invention provides a method of determining activation levels for feedback suppression in an audio amplification apparatus, the audio amplification apparatus including:

a forward transfer path connectable to an output transducer;

a feedback path adding a feedback signal to the forward transfer path; and feedback suppression means for selectively compensating for the presence of an undesired feedback signal component when a signal output level is greater than a predetermined activation level; the method including the steps of:

determining a listener disturbance threshold level D at each frequency;

determining the amplification H at each frequency;

determining feedback path transfer function G at each frequency; and determining the activation level A at each frequency from the disturbance threshold level, amplification and feedback path transfer function at each frequency according to:

$$|A|=|D|-|H|-|G|$$

In at least one embodiment of the invention, the disturbance threshold level may be a hearing threshold level.

When the forward transfer path is disconnected from the output transducer during fitting, the feedback path transfer function G at each frequency may be determined by:

presenting stimuli to the output transducer at a plurality of frequencies;

recording output transducer signal components and feedback signal components at the plurality of frequencies; and deriving the feedback path transfer function G at each frequency from the output transducer signal components and feedback signal components.

The feedback path transfer function G at each frequency may be determined by:

adjusting the amplification at each frequency;

deriving the feedback path transfer function G at that frequency from the lowest amplification at which feedback oscillation is detected.

When the forward transfer path includes a frequency transposing element, the activation level A at each frequency may be determined from the amplification and feedback path transfer function at that frequency and from the disturbance threshold level at a transposed frequency.

When the forward transfer path is disconnected from the output transducer during fitting, the method may further including the steps of:

presenting stimuli to the output transducer at a plurality of frequencies;

adjusting the stimulus level at each frequency to meet a predefined loudness perception level or detection threshold of the listener;

measuring feedback signal components resulting from the stimuli at the plurality of frequencies;

determining the amplification at the plurality of frequencies from the stimuli and standardised input signal components; and determining the activation level at each frequency from the levels of stimulus, feedback signal component, disturbance threshold level and amplification at each frequency.

Each activation level As may be determined according to:

$$A_s=S+\{D-[F_s+H]\}$$

where at each frequency, S is the magnitude of the stimulus, D is the listener's hearing threshold level, $F_s$ is the feedback signal component resulting from the stimulus and H is the amplification.

The forward transfer path may include a frequency transposing element, and the activation level As at each frequency may be determined from S, $F_s$ and H at that frequency and D at a transposed frequency.

A further aspect of the invention includes a method of fitting an audio amplification apparatus, including the steps of:

adjusting frequency-dependent amplification in the audio amplification apparatus according to the above described frequency-dependent amplification method; and determining activation levels for feedback suppression in the audio amplification apparatus according to the above described activation level determining method.

A still further aspect of the invention provides a signal processing device for use in an audio amplification apparatus, the device acting to receive digitised sound signals and generate output transducer signals, the sound processing device including:

processing means for use in performing a method according to any one of the preceding claims.

Conveniently, the processing means may be implemented in digital signal processing (DSP) technology.

The following description refers in more detail to the various features of the present invention. To facilitate an understanding of the invention, reference is made in the description to the accompanying drawings where the invention is illustrated in a preferred embodiment. It is to be understood that the invention is however not limited to the preferred embodiment illustrated in the drawings.

Figure 4:
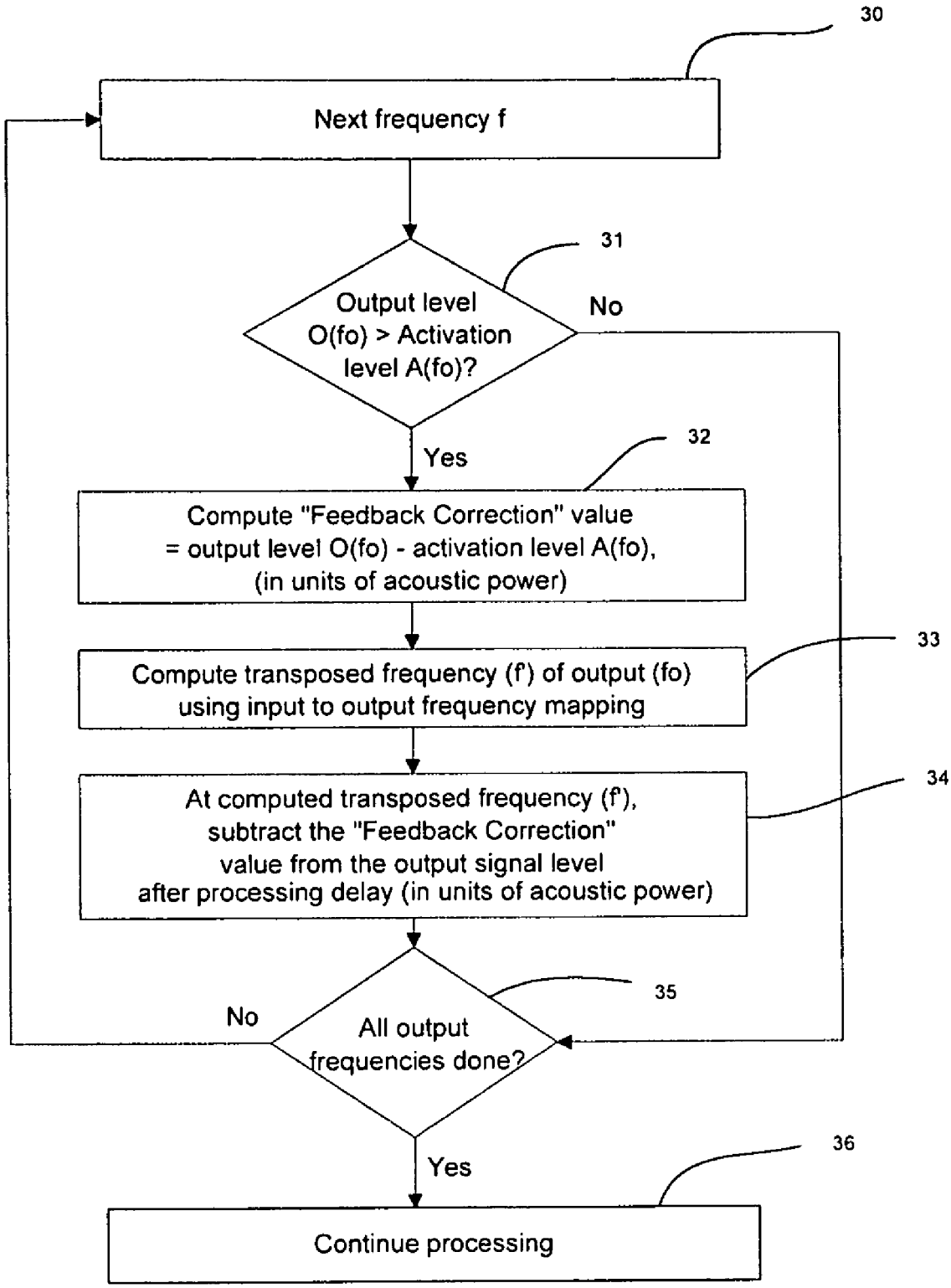
FIG. 4 is a flow chart showing functional steps performed by part of the sound processing device of FIG. 3.
Figure 5:
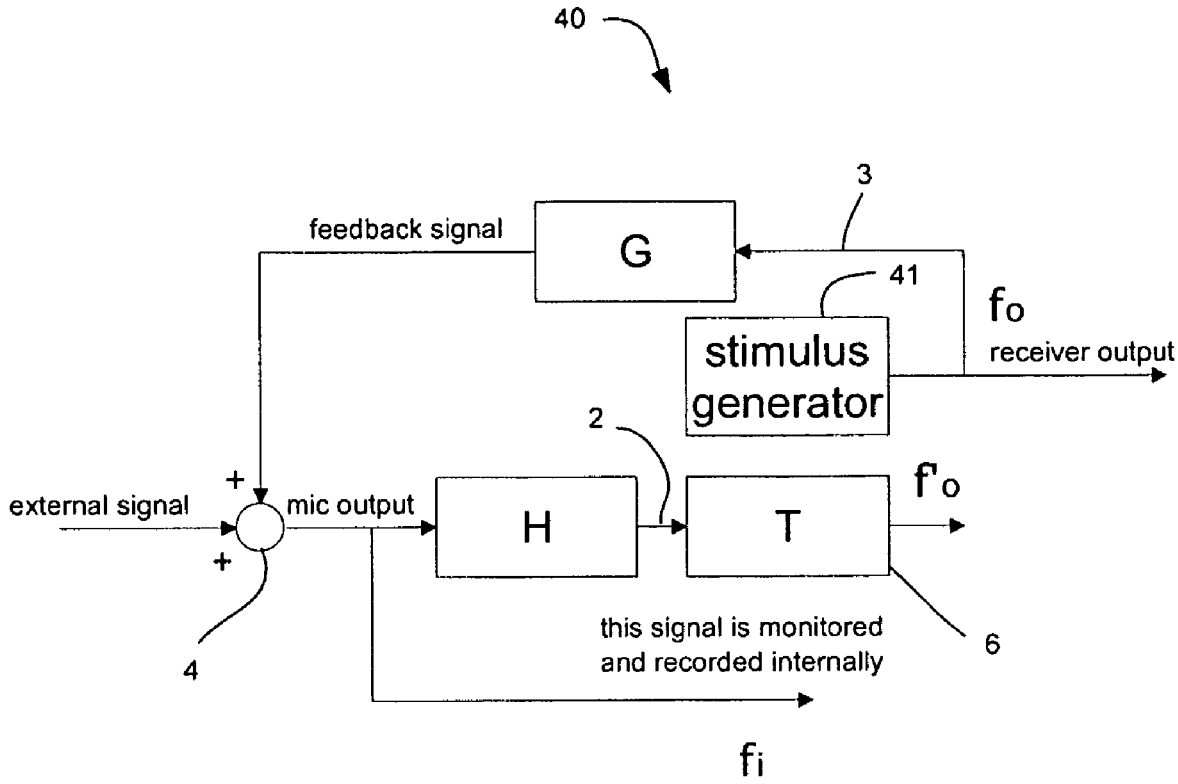
FIG. 5 is a schematic diagram illustrating a model of an acoustic amplification device and a stimulus generator for use in the fitting of the acoustic amplification device to a user.
Figure 7:
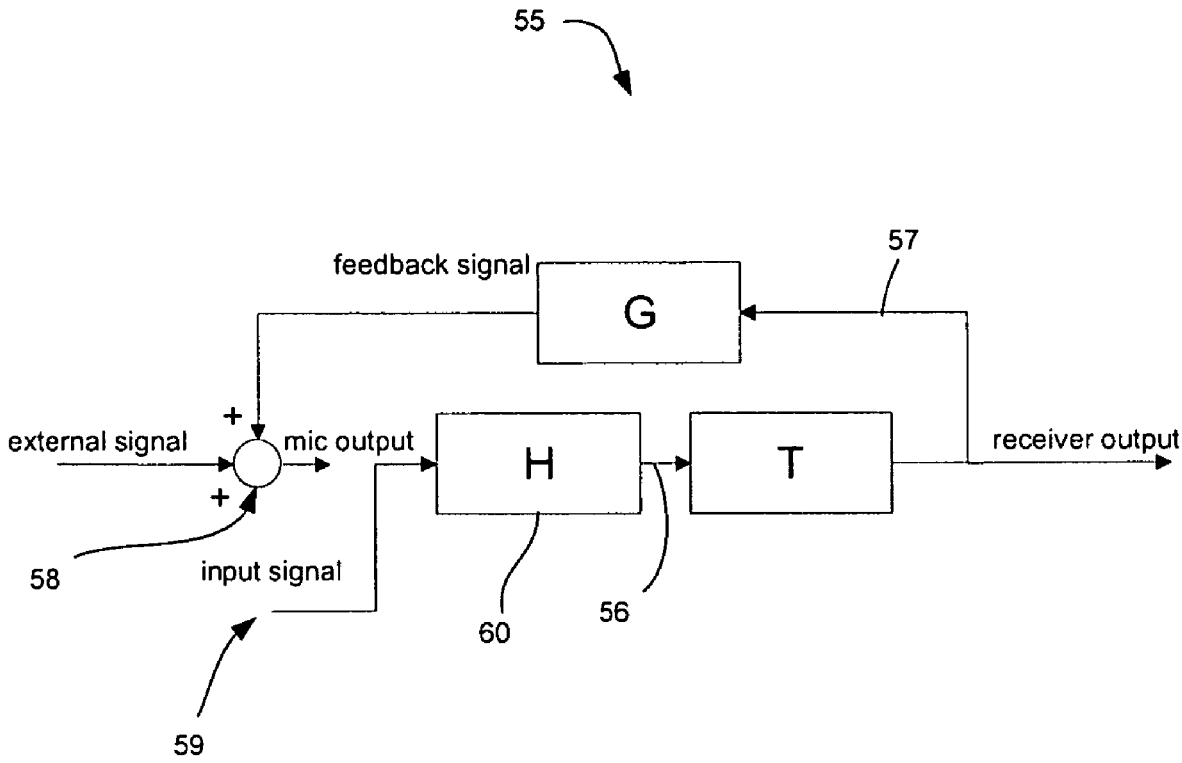
Figure 8:
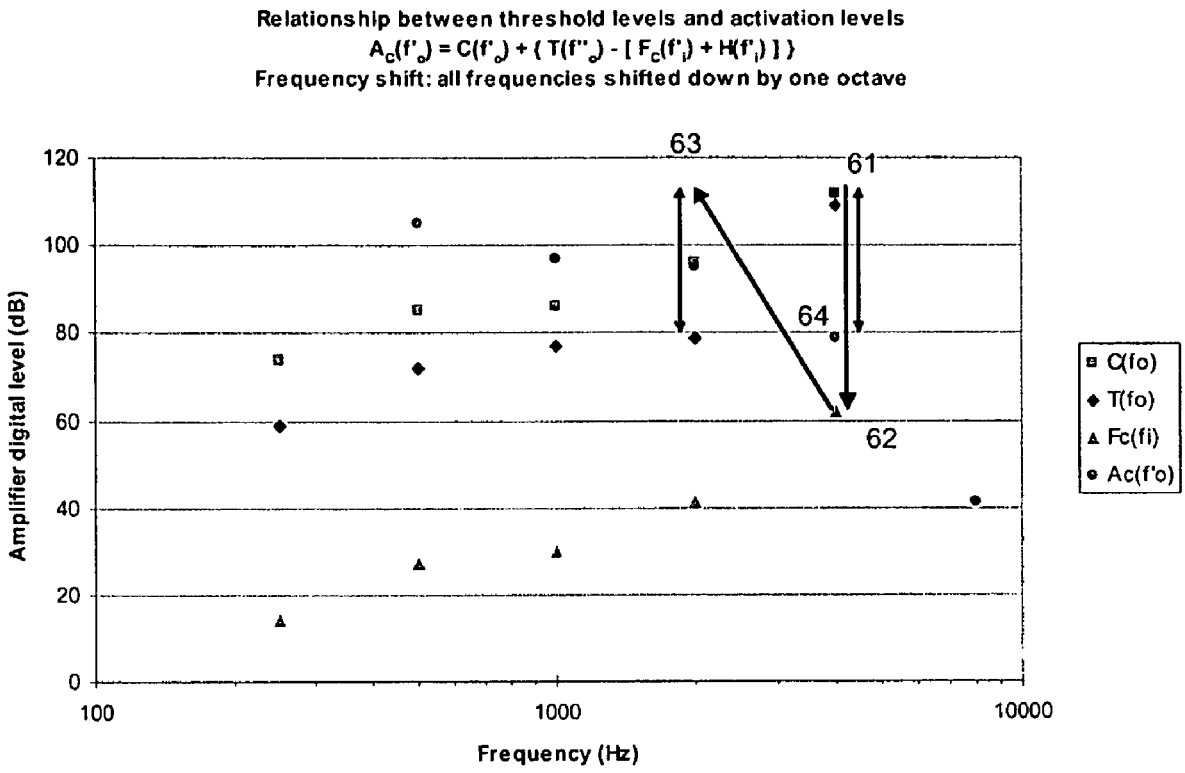

FIG. 7 is a schematic diagram illustrating another model of an acoustic amplification device for use in the fitting of the acoustic amplification device to the user for determining frequency-dependent amplifications during fitting; and FIG. 8 is a graphical representation of the feedback signal components, amplifications, stimulus levels and hearing threshold levels from the audio amplification device shown in FIG. 5 as used to determine activation levels used in the flow chart shown in FIG. 4.

Figure 3:
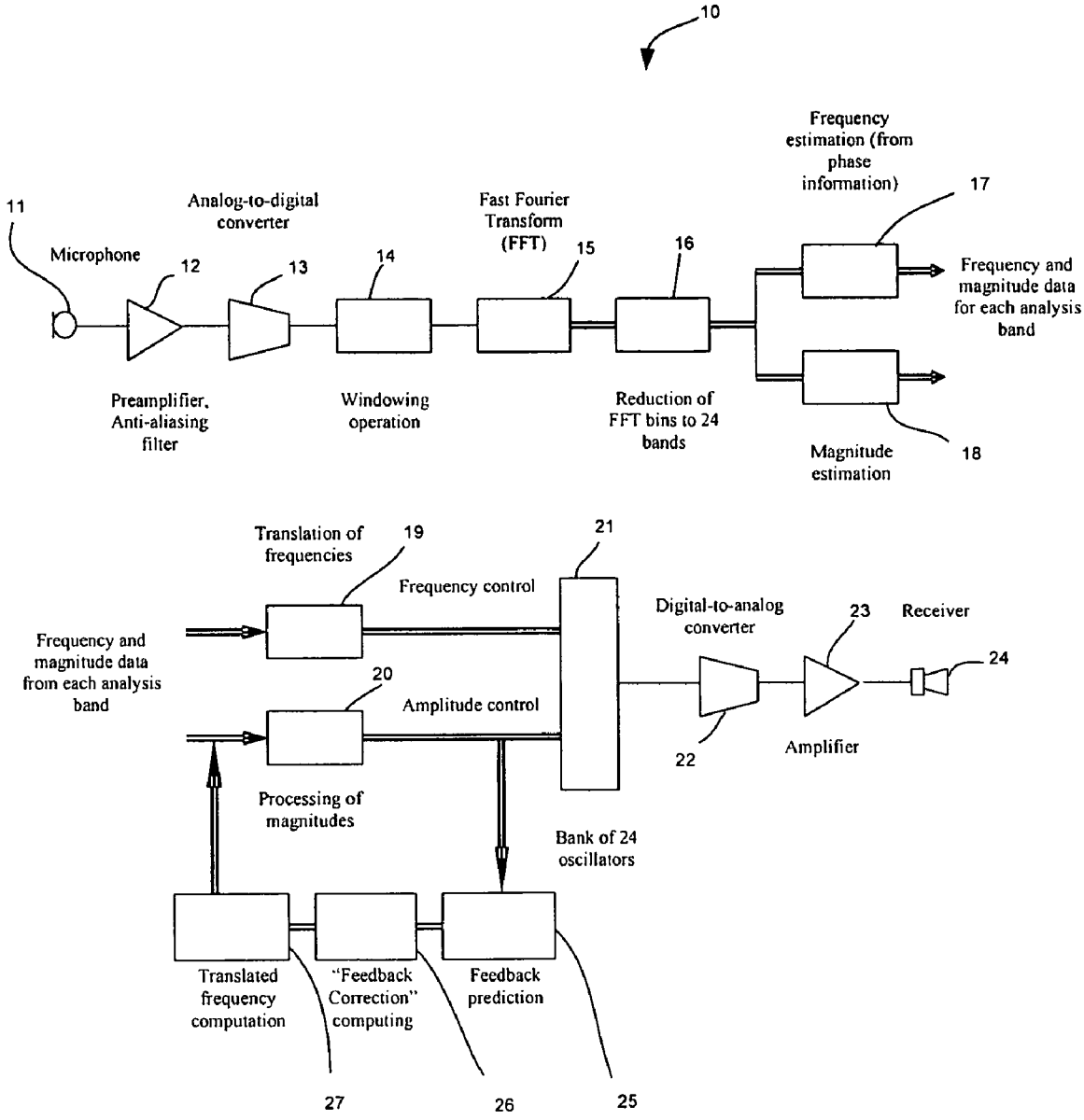
FIG. 3 is a schematic diagram of an embodiment of a sound processing device using frequency translation in accordance with one embodiment of the present invention.

Referring now to FIG. 3, there is shown generally a sound processing device 10 in which input signals from a microphone are sampled, converted to a digital representation, and then periodically subject to a windowing operation followed by a Fast Fourier Transform (FFT). The result of the FFT is analysed to estimate the magnitude and phase of each frequency component of the input signal. The magnitudes are processed to produce amplitude control signals which are assigned to a number of oscillators. These oscillators are tuned to appropriate frequencies using information derived from the changes over time in the phase estimates. The final output signal is constructed by summing the output signals for the oscillators, and subsequently converting the composite signal from digital to analogue form. The composite output signal is then conveyed to a suitable transducer, such as the earphone (receiver) of a hearing aid.

In more detail, an input sound signal received at a microphone 11 is pre-amplified and filtered to limit its bandwidth in the preamplifier and anti aliasing filter. An analogue to digital converter 13 samples the band limited signal at a constant rate and converts the sampled signal into digital form. In the exemplary implementation of the present invention, a block of sequential input samples is placed in the memory of a suitable digital signal processing (DSP) unit. These samples are windowed by a windowing block 14 which multiplies each sample by a corresponding coefficient. Various windowing functions defining suitable sets of coefficients have been described in the literature readily available to those skilled in the art. The purpose of the window is to ensure that the subsequent FFT operation performed by an FFT block 15 produces an acceptable estimate of the short term spectrum of the input signal without noticeable distortion or other undesirable side-effects.

A 256 point window with coefficients defined by the product of a hamming window and a mathematical sinc function is suitable when an input sampling rate of 14.4 kHz is used. The window of outputs are stacked and added (using a standard numerical operation known as folding) to produce a set of windowed input samples. This set of data is then processed by the 128 point FFT block 15.

Figure 1:
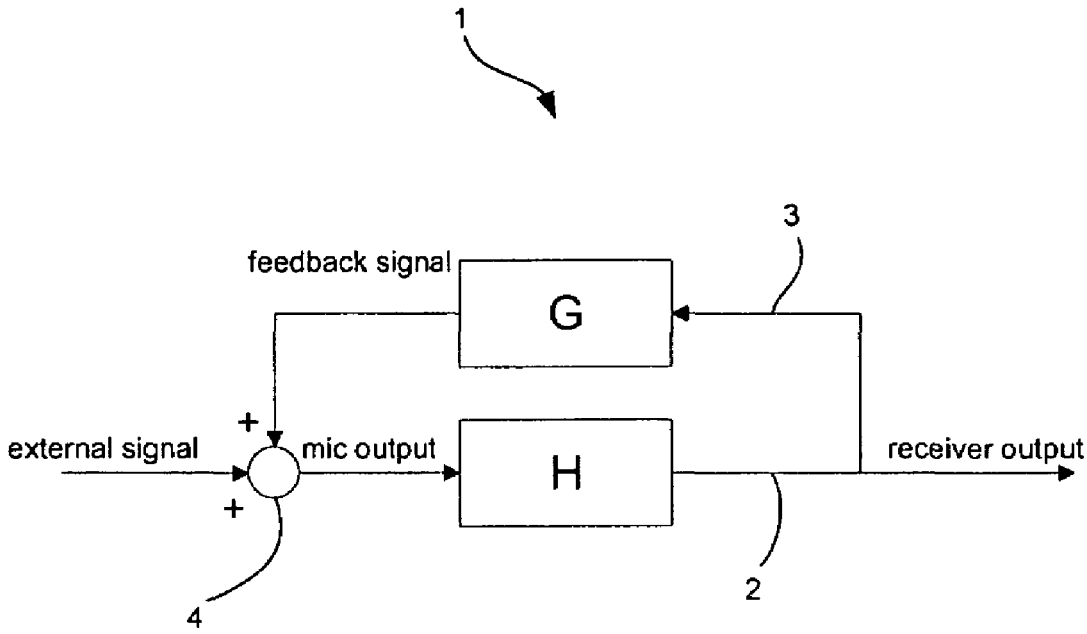
FIG. 1 is a schematic diagram illustrating a model of an acoustic amplification device including a forward transfer path and a feedback path.

The FFT and subsequent processing performed by the sound processing device of FIG. 1 are executed every time a new set of 32 samples has been obtained from the input transducer. Thus, with the sampling rate of 14.4 kHz, the FFT and subsequent processing steps are repeated at intervals of approximately 2.2 ms. However, it will be appreciated that differing sampling rates, different types and links of the window function and Fourier transform, and different extents of FFT overlap may be envisaged.

The outputs of the FFT block 15 comprise a set of complex numbers which together represent approximately a short term spectrum of the input signal. With a 128 point FFT, the first 64 bins contain spectral estimates covering the frequency range of zero to 7.2 kHz, approximately (for a sampling rate of 14.4 kHz). Ignoring the first and last of these bins, which generally do not contain signals of interest in the present exemplary hearing aid implementation of the sound processing device, the remaining bins each provide information about a substantially contiguous sub band of the input frequency range, each bin extending over a bandwidth of approximately 112.5 Hz. For example, the first bin of interest contains a complex number which describes the real and imaginary components of the input signal-within a bandwidth of approximately 112.5 Hz centred on a frequency of 112.5 Hz. The power of each component of the input signal is estimated for each frequency bin by summing the squares of the real and imaginary parts of the complex estimate.

A well known deficiency for the FFT for spectral analysis in general is that the output bins are spaced at constant frequency intervals (e.g. 112.5 Hz in the present case, and have a constant band width, e.g. approximately 112.5 Hz). For the purposes of frequency transposition as outlined above, it is desirable to obtain a more precise estimate of the frequency content of the input spectrum than is possible using FFT alone, especially at relatively low frequencies. As is described in co-pending Australian Patent Application No 2002300314, filed July 29, this can be achieved by making use of information contained in the phase value represented in each frequency bin at the output of the FFT block 15. This extension of the standard FFT process is embodied in an algorithm described as a phase vocoder.

Firstly, the phase angle is estimated by calculating the inverse tangent of the quotient of the imaginary and real parts of the complex number in each FFT bin. A look-up table is provided containing the pre-calculated tangents of a relatively small number (e.g. 64) of phase values. This table contains discrete samples of the range of possible phase values over any two quadrants (e.g. for phase values between $-\pi/2$ and $+\pi/2$ radians). These values correspond to the case where the real part of the complex number from the FFT bin is positive. If the real part is in fact negative, it is firstly treated as positive, and later the phase estimate is corrected by adding an appropriate constant to the phase angle initially calculated.

The phase value for each FFT bin is estimated by a process of successive approximation. A starting value for the phase angle being sought is selected, and the tangent of that value is obtained from the look-up table. The tangent of the candidate phase value is then multiplied by the imaginary part of the complex number in the FFT bin. The product is then compared with the corresponding real part, and the candidate phase value is adjusted up or down according to the difference between the estimated and actual real path.

Next the new candidate value is used to obtain the corresponding tangent from the look-up table. This process is repeated until the candidate phase value has the desired accuracy. It has been found that adequate precision can be obtained with a 64 entry look-up table encompassing a phase range of $-\pi/2$ to $+\pi/2$. Because multiplication and table look-ups can be carried out very rapidly and efficiently in current DSP devices, the above described algorithm is particularly suitable for use in a wearable, digital hearing aid.

To use the phase estimates to improve the resolution of the frequency analysis provided by the FFT, the rate of change of the phase in each FFT bin over time is estimated. This is because the rate of phase change in a particular bin is known to be proportional to the difference in frequency between the dominant component contained in that bin and the nominal centre frequency of the bin. In this implementation, the rate of phase change for each bin is calculated by subtracting the phase estimates obtained from the immediately previous FFT operation from the current phase estimates. Phase differences are accumulated over time, and then multiplied by a suitable scaling factor to represent the frequency off-set between the input signal component dominating the content of each FFT bin and the corresponding centre frequency for that bin. It will be appreciated that alternative processes to determine the phase estimates may be used, for example, a direct calculation process.

The processing described thus far results in a set of power estimates representing the square of the magnitude spectrum of the input signal, and a set of precise frequency estimates representing the dominant components present in the input signal. These sets comprise one power value and one frequency value for each FFT bin. These sets normally contain 62 power and frequency values assuming that a 128 point FFT is employed.

In the present example, a bank of 24 oscillators is used in the sound processing device 10. In FIG. 3, the bank of oscillators is indicated by the reference 21. The information contained in the 62 FFT bins is reduced to 24 bands in the reduction block 16, with each band assigned to a corresponding oscillator. The frequency range covered by the 24 bands are normally, but not necessarily, contiguous. The reduction of the FFT bins to a smaller number of bands may be accomplished in various ways. One practical technique is to exploit the fact that less frequency resolution is generally needed in an assistive hearing device at high frequencies than at low frequencies. Thus the contents of several relatively high frequency FFT bins can be combined into a single processing band. The combining operation is performed by summing powers of the FFT bins, and by obtaining the required precise frequency estimate from only one of the combined bins. The bin selected for this purpose is the one containing the highest power out of the set of combined bins. For low frequency FFT bins, each bin is usually assigned separately to a corresponding band for further processing.

The outputs of each of the 24 bands are then analysed by a frequency estimation block 17 and a magnitude estimation block 18 to derive an estimate respectively of the frequency and magnitude of each of the 24 bands of the input signal. The frequency estimation is derived from phase information provided by the reduction block 16.

Frequency and magnitude data for each analysis band are provided to a frequency transposition block 19 and magnitude processing block 20. Each of the 24 oscillators in the sound processing device 10 generates a sine wave that can be controlled in both amplitude and frequency. The desired amplitude is determined by the magnitude processing block 20 from the magnitude data for the corresponding band. The conversion between the power value and the desired oscillator amplitude may be specified by a look-up table or calculated from an appropriate equation. Accordingly, any desired amount of amplification or attenuation of the input signal may be achieved at each frequency (i.e. within the frequency range associated with each band).

The desired oscillation frequency of each oscillator is set by the frequency translation block 19 and may be specified by a look-up table or calculated from an equation. For example, if no change to the frequencies present in the input signal is required, each of the oscillators is merely tuned to generate the same frequency as that estimated from input signal in the corresponding band as determined by the frequency estimation block 17. However, if frequency translation is required to be formed by the frequency translation block 19 (for example, lowering of one or more input frequencies by 1 octave), then the frequency estimated from the input signal in each band is multiplied by an appropriate factor (for example, 0.5) before applying it to tune the corresponding oscillator. It should be noted that both the amplitude control and the frequency control for each oscillator can be specified completely independently of the operation of all other oscillators. Thus it is possible to lower some input frequencies and not others, or to lower each input frequency by a different amount. It will be appreciated that it is also possible to raise input frequencies in the same manner.

Accordingly, amplitude control signals are provided from the magnitude processing block 20 to each of the 24 oscillators in the bank of oscillators, whilst frequency control information is provided from the frequency translation block 19 to that same bank of oscillators.

The composite output signal is produced by summing the output signals from the bank of all 24 oscillators. The composite signal is then converted to analogue form by the digital to analogue converter 22 and amplified by amplifier 23 to drive a suitable transducer 24 (such as the earphone of a hearing aid or other receiver).

Feedback artefacts resulting from the frequency translation carried out in the sound processing device 10 are compensated for or removed. Given the input to output frequency mapping employed by the sound processing device 10, it is possible to predict the frequency of the feedback signal produced by any given external signal. The time delay between the original external signal and its corresponding frequency lowered feedback signal can also be accurately predicted and is directly related to the signal processing delay of one complete loop around the system.

The output signal level at the input frequency of each of the 24 bands is accordingly monitored by a feedback prediction block 25 to determine if it is above or below a predefined activation level. If the output signal level is above the activation level, a feedback correction block 26 computes the difference between the output signal level and the predetermined activation level in terms of acoustic power. In alternative embodiments of the invention, the difference may be computed in terms of decibels.

In the transposed frequency computation block 27, the transposed frequency at which the undesired feedback signal component will occur is calculated, and the calculated difference is used to effectively "correct" the output signal at that transposed frequency to compensate for the presence of the undesired feedback signal component. In the context of the present invention, "translation" is to be understood as encompassing any form of frequency modification including, for example, frequency shifting, frequency compression and any shift in frequency from a first to a second value.

The activation level is an estimate of the output signal level which will result in a feedback signal which, when amplified and transposed, will be audible or otherwise create a perceptual disturbance to the listener. A set of activation levels are required by the feedback detection block 25 to activate the feedback suppression at the frequency of each of the 24 bands. The characteristics of the feedback path may be different for each situation, and may change over time. Accordingly, the activation levels may be fixed or may be adaptable to change according to changes in the characteristics of the feedback path over time.

FIG. 4 illustrates in more detail the operation of the sound processing device 10 during suppression of an undesired feedback signal component resulting from frequency translation. At step 30, a first frequency of an output signal intended to drive one of the oscillators in the bank is analysed. At step 31, the output signal level at that output frequency is compared with the activation level. If the output signal level is below the activation level, there is no need to perform any feedback suppression at that frequency, and processing moves on to the next output frequency. If however, the output signal level is above the activation level, the difference between them is calculated at step 32 in terms of acoustic power. At step 33, the transposed frequency of the undesired feedback signal component is computed using input to output frequency mapping. This computation determines the frequency at which the undesired feedback signal component is effectively applied as an additional input signal to one of the oscillators in the bank.

In step 34, at the computed transposed frequency, the feedback correction value is subtracted from the output signal level after an appropriate delay dependent on the processing delay of the amplifier. At step 35, a determination is made as to whether all output frequencies have been analysed, and if so, processing is continued by other elements of the sound processing device 10 at step 36. The quantity that is subtracted from the output signal level is best done in terms of acoustic power (squared linear amplitude). However, due to programming efficiency, it may be more advantageous to perform computations in terms of decibels in some situations, for example when the total signal level is not greatly above the audibility threshold at the expected feedback frequency.

If the activation level is set to low, feedback suppression will cause the amplifier to reduce the output level at a given transposed frequency, even when no feedback signal is present. This may result in a reduction of the wanted signal even if there was one present at that frequency. If the activation level is set to high, feedback artefacts will be present at the transposed frequency, and may be audible.

In the described embodiment, the undesired feedback signal component is subtracted from the output signal at each of the transposed frequencies to compensate for the pressure of the undesired feedback signal component. However, it will be appreciated by those skilled in the art that in alternative embodiments, the undesired feedback signal component may be subtracted from the input sound signal, prior to amplification and frequency translation, in order to achieve the same connection of the output signal.

In yet other alternative arrangements, the amplification of the input sound signal at each of the transposed frequencies may be reduced to compensate for the undesired feedback signal component.

In a preferred embodiment of the invention, the sound processing device is implemented according to digital signal processing techniques. As described above, the input signal is windowed and processed as a block of data every 2.2 ms which corresponds to 32 input data samples at a sampling rate of 14.4 kHz. The output signal of the amplifier 23 is generated by summing together the outputs of the 24 oscillators in the bank. The amplitude and frequency controls of the oscillators are determined by pre-processing of the input signal and are updated once for every block of data analysed.

One example of a practical fitting procedure to determine the frequency-dependent amplifications of the amplifier involves obtaining a subjective rating of loudness from the listener. The subjective loudness of a stimulus can be judged using a loudness rating scale, such as one containing nine loudness descriptors: Very soft, Soft, Comfortable but slightly soft, Comfortable, Comfortable but slightly loud, Loud but OK, Uncomfortably loud and Extremely uncomfortable. In the following example, a set of comfortable but slightly soft levels are measured and used to determine the desired amplification versus frequency of the amplifier. An appropriate set of stimuli, each of narrow bandwidth, is chosen to be presented to the listener. In one preferred procedure, these stimuli are narrow-band noises, each of one-third octave bandwidth, centred at standard frequencies (i.e. 100, 125, 160, 200, 250, 315, 400, 500, 630, 800, 1000, 1250, 1600 Hz, etc).

In one embodiment, the stimuli are presented to the listener using an audio amplifier apparatus having a theoretical model 40 shown in FIG. 5. It will be noted from this Figure that transducer output is temporarily disconnected from the amplifier circuit to break the feedback loop, thus eliminating any feedback signal from the output. A stimulus generator 41 is connected to the receiver to deliver the desired stimulus to the listener via the transducer. At each stimulus frequency, the stimulus is generated and presented to the listener. The listener responds by describing the perceived loudness. The level of the stimulus is increased and decreased during the fitting procedure so as to converge upon a level which is perceived by the listener to be comfortable but slightly soft.

In one practical implementation, each stimulus is presented to the listener, and the listener chooses the most appropriate loudness descriptor from a written list of loudness categories. The stimuli may be presented with varying level and frequency in an appropriate sequence until the loudness at each frequency is perceived as comfortable but slightly soft.

An alternative practical implementation involves comparing the loudness of each stimulus with that of a reference stimulus at a selected, fixed frequency. The level of the reference stimulus is set to evoke a loudness perceived as approximately comfortable but slightly soft, and its frequency is chosen to be relatively close to the frequencies of the other stimuli to be presented. In this loudness balancing procedure, each such stimulus maybe presented to the listener with the reference stimulus in a sequential pair (i.e. reference stimulus followed by comparison stimulus, or vice versa), and the listener is asked which of each pair of sounds is louder. The level of the reference stimulus is kept constant. The level of each comparison stimulus is adjusted until its loudness is perceived to be equal to that of the reference stimulus.

In one preferred embodiment, the system shown in the attached drawings is implemented partly in a digital signal processor. The level of signals is digitally measured and recorded without the need for separate sound measurement equipment. The level of the stimulus output is recorded for each level found to produce comfortable but slightly soft loudness at each frequency.

The following notation is introduced to help describe the relationship between the different levels measured and the frequencies at which they are defined:

f with subscript 'o' is an amplifier output frequency;

f with subscript 'i' is an amplifier input frequency;

when $f_o$ and $f_i$ are used as arguments in the following formulas, they define whether the function is referred to an output frequency or an input frequency, respectively;

in the following formulas, f' denotes the frequency-shifted version of f. (Similarly, f'' denotes the frequency-shifted version of f'.)

The following functions of frequency are defined:

$I(f_i)$ is the level of international long-term average speech spectrum (ILTASS, defined in [D. Byrne, H. Dillon, K. Tran, S. Arlinger, K. Wilbraham, R. M. Cox, B. Hagerman, R. Hetu, J. Kei, C. Lui, and J.

Kiessling, "An international comparison of long-term average speech spectra," Journal of the Acoustical Society of America, vol. 96, pp. 2108-2120, 1994]) at each frequency for speech at an overall level of 70 dB SPL, and is a function of input frequency;

$C(f_o)$ is the comfortable but slightly soft level as a function of output frequency $H(f_i)$ is the forward amplification of the amplifier, and is a function of input frequency The amplification required at each input frequency can be defined as the difference (in dB) between the amplifier input ILTASS level and the comfortable but slightly soft level at the shifted (output) frequency. This can be described by the equation:

$$|H(f'_i)|=|C(f'_o)|-|I(f'_i)|.$$

This means the set of required amplification can be calculated from the set of comfortable but slightly soft levels and the known ILTASS input levels.

In other words, by presenting stimuli to the transducer output at a number of frequencies, and then adjusting the stimulus level at each frequency to meet the predefined loudness perception levels or detection threshold of the listener, an equal loudness contour of transducer output levels can be derived from the adjusted stimuli levels. The equal loudness contour is derived by interpolating between each of the adjusted stimuli levels at the frequencies at which the stimuli are presented to the receiver. The set of required amplifications are then derived by subtracting the magnitude of the known ILTASS level at a particular frequency from the magnitude of the stimulus level defined by the equal loudness contour at the transposed frequency resulting from the frequency transposing element in the forward transfer path.

Figure 6:
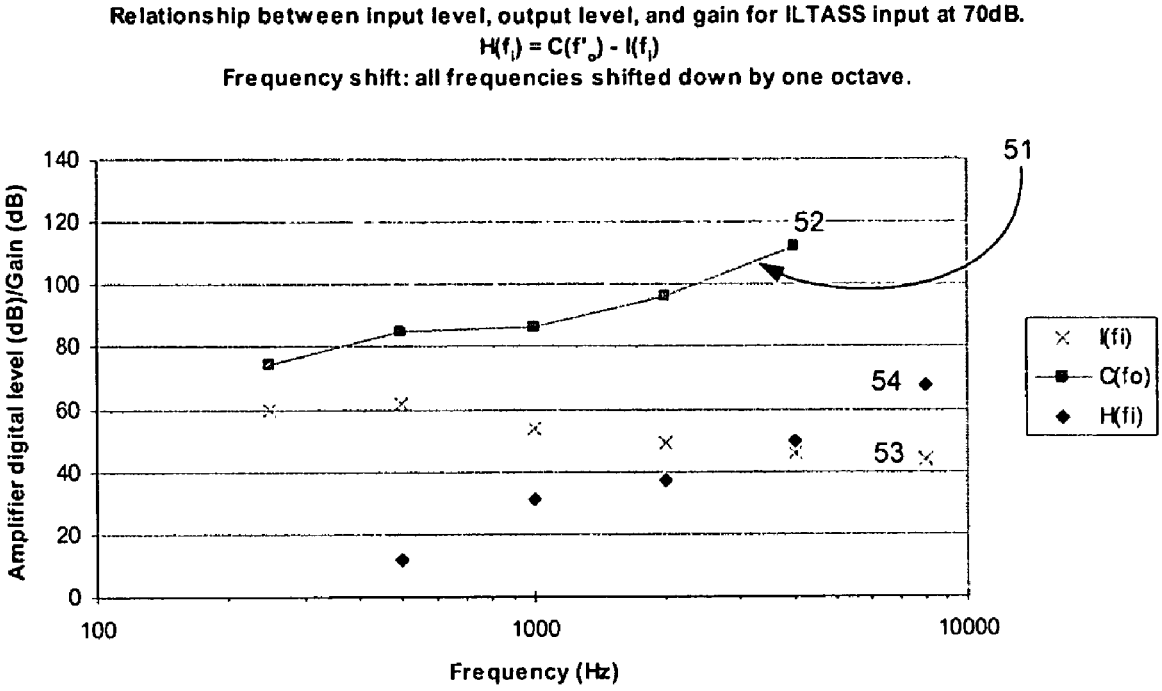
FIG. 6 is a graphical representation of the stimulus signal components and ILTASS standardised input signal levels from the acoustic amplification device shown in FIG. 5 together with derived amplifications.

An example of this is shown in FIG. 6. This Figure illustrates the relationship between input level, output level, and amplification for a downward frequency shift performed by the frequency transposing block 6 of one octave across all frequencies. The amplifications of the amplifier 40 make the output signal comfortable but slightly soft for each one-third octave frequency component when the input frequency components have levels corresponding to those of an average speech signal at 70 dB SPL overall level. It will be appreciated from the foregoing that in the absence of any external signal applied to the amplifier 40, the input signal applied to the forward transfer path of the amplifier 40 corresponds to the feedback signal applied to the summation device 4 from the feedback path 3.

Stimuli are presented to the transducer from the stimulus generator 41 at a series of frequencies separated by one third of an octave. The stimulus level at each frequency is adjusted to meet the predefined loudness perception level of the listener, in this case the comfortable but slightly soft level. The adjusted stimulus levels are then used to derive an equal loudness contour of transducer output levels—referenced 51 in FIG. 6—by interpolating between the stimulus levels.

In the present example of an audio amplification apparatus involving a feedback suppression system with frequency transposition, the amplification of the amplifier at each desired frequency is determined by subtracting the magnitude of the ILTASS standardised input signal component at that frequency from the magnitude of the stimulus at a transposed frequency as read from the equal loudness contour 51.

In the example shown in FIG. 6, a 4000 Hz stimulus with a level producing comfortable but slightly soft loudness is referenced 52. In post-fitting operation, such a stimulus will have arisen from an input signal in the forward transfer path of an amplifier at 8000 Hz, which will then be frequency transposed downward by one octave to 4000 Hz. Accordingly, the ILTASS standardised input signal component level at 8000 Hz, referenced 53, is used to determine the amplification at 8000 Hz. The difference between the amplitudes of the ILTASS standardised input signal component level 53 at 8000 Hz and stimulus level 52 at 4000 Hz is then used to derive the amplification to be applied at 8000 Hz, referenced 54 in FIG. 6.

It will be appreciated that in the case of audio amplification apparatus that does not include frequency transposition, the difference between the amplitudes of the ILTASS standardised input signal component level and stimulus level at the same frequency are used to derive the amplification to be applied at that same frequency.

Figure 2:
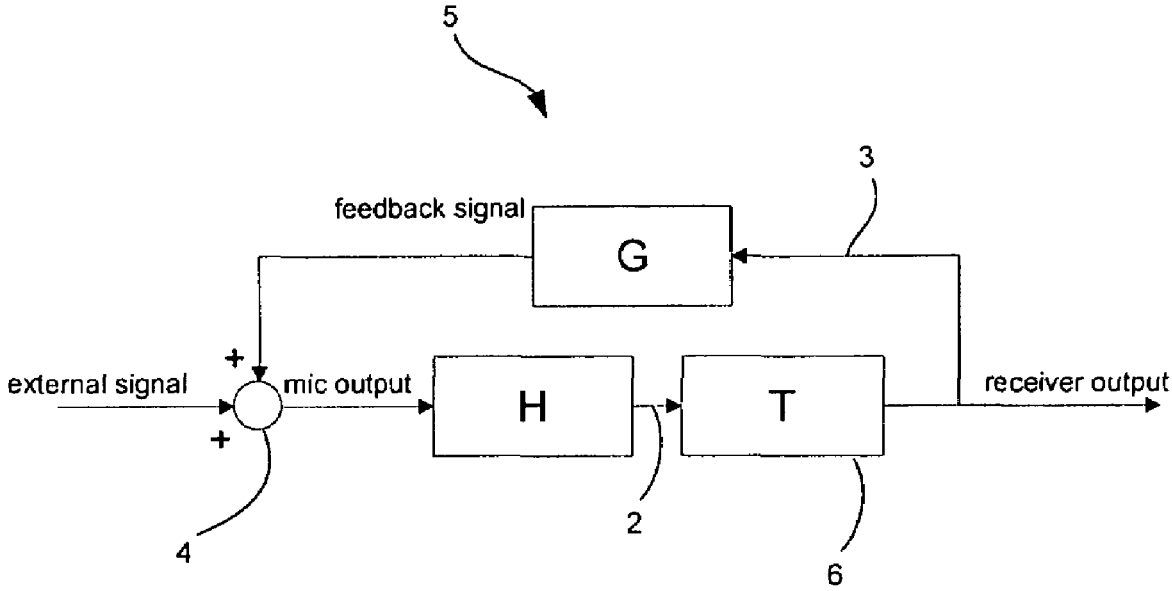
FIG. 2 is a schematic diagram illustrating a model of an acoustic amplification device using frequency translation to minimise the effect of feedback.

It is to be understood that other methods may be used for adjusting the frequency dependent amplification of the audio amplification apparatus. For example, assuming that the feedback path gain is small and has little influence on the closed loop system shown in FIG. 2, the output signal equal loudness level contour C(f) can be defined in units of dB by:

$$|I(f_i)|+|H(f_i)|=|C(f_o')|$$

The value of |H(f)| can be derived from any loudness contour, as described above. Accordingly, the frequency dependent amplification can be obtained by presenting stimuli to the receiver at a number of frequencies, adjusting the stimulus level at each frequency to meet a predefined loudness perception level of the listener, deriving an equal loudness contour of transducer output levels from the adjusted stimuli levels, and deriving the frequency dependent amplification of levels of input signals at each frequency from the equal loudness contour at the corresponding transposed frequencies.

Methods of measuring equal loudness contours sometimes use headphones or other apparatus that require conversion of measured levels to those used in a hearing aid. Individual ear canal shape and hearing aid type influence these conversions which are based on population averages rather than individual characteristics. One way of adjusting the frequency dependent amplification in an audio amplification apparatus which addresses this issue is to use the hearing aid itself to effectively obtain an equal loudness contour.

FIG. 7 shows a theoretical model 55 of an audio amplification device including a forward transfer path 56 and a feedback path 57. In this arrangement however, the feedback path is disconnected from the forward transfer path during hearing aid fitting. In this instance, the feedback loop is broken at the microphone output 58, and a desired input signal is applied at the input 59 to the amplifier 60 in the forward transfer path 56. At each frequency, the relevant ILTASS standardised input signal component is applied, and the amplification H(f) is adjusted until the listener indicates that the receiver output meets a predefined loudness perception level of the listener. In this instance, it is not necessary to measure each output level or output frequency of the hearing aid, nor measure the value at which the amplification is set, as long as the set of known input stimuli at the various frequencies applied to the amplifier illicit an equally loud perception level by the user.

The manner in which the activation levels described in relation to FIG. 4 are derived will now be discussed. An appropriate set of stimuli, each of narrow bandwidth, is again chosen to be presented to the listener by the stimulus generator 41. In one preferred embodiment, these stimuli are narrow-band noises, each of one-third octave bandwidth, centred at standard frequencies (i.e. 100, 125, 160, 200, 250, 315, 400, 500, 630, 800, 1000, 1250, 1600 Hz, etc).

Using the apparatus shown in FIG. 5, the stimuli are presented one at a time at an appropriate level. The level chosen may be the listener's hearing threshold level, their comfortable but slightly soft level, or some other predefined loudness perception level which elicits a detectable amount of feedback. There is a time-saving advantage in choosing the listener's hearing threshold level, or their comfortable but slightly soft level, since these levels are presented to obtain other data required for aid fitting, as described above.

Ideally, the apparatus and listener are situated in a quiet environment (e.g. a sound-proof, or semi sound-proof booth), where background noise levels are low. In order to make reliable and repeatable measurements in the presence of any ambient background noise, the level of the stimuli (and feedback signals) should be high enough to ensure a relatively high signal-to-noise ratio. This needs to be considered when choosing the level of the stimuli to be presented. To further reduce the influence of background noise on the reliability of measurements, it is possible to obtain a set of activation levels from more than one set of stimulus levels; for example, from both the threshold levels and the comfortable but slightly soft levels. These independently measured activation levels could then be combined to produce a single, more accurate set of data.

For each stimulus that is presented, the following data are recorded:

the output level of the stimulus that is presented;

the input level of the feedback signal that results from delivery of the stimulus.

The following functions of frequency are defined:

S(fo) is the level of the stimulus, and is a function of output frequency;

D(fo) is the listener's hearing threshold level as a function of output frequency;

$F_s$(fi) is the level of the feedback signal created by S(fo), and is a function of input frequency;

$A_s$(fo) is the activation level of the feedback suppressor and is a function of output frequency. The subscript S indicates that the activation levels were obtained in response to the set of stimuli, S(fo).

The transfer function of the feedback path can be determined by comparing the stimulus level S(fo) with the feedback signal level $F_s$(fi).

The feedback suppressor should become active once the output level is above the activation level. The activation level is defined as the output level which causes a feedback signal which, when amplified and optionally shifted in frequency by the hearing aid, will be just audible (or just disturbing) to the listener.

An alternative definition for the activation level is the output level that causes a feedback signal which, when amplified and shifted in frequency, would be just above the inherent noise level of the amplifier. When present at the input, the feedback signal is amplified and optionally shifted in frequency, and the corresponding output level is determined by the amplification, H(fi). The relationship between activation level, stimulus level, feedback level, and threshold level in the case of the amplifier shown in FIG. 5, is defined as follows:

$$A_S(f'_o)=S(f'_o)+\{D(f''_o)-[F_S(f'_i)+H(f'_i)]\}$$

It will be appreciated that in audio amplification apparatus having feedback suppression schemes that do not use frequency transposition, the magnitude of the stimulus, listener's hearing threshold level, feedback signal component and amplification may all be taken at the same frequency to determine the activation level at which the undesired feedback signal component is suppressed at that same frequency.

The example in FIG. 8 shows the activation levels calculated from a stimulus set of comfortable but slightly soft levels, C(fo), and the corresponding feedback signals. The subscript 'C' has been used to indicate that the set of activation levels, $A_C$(fo), and the set of feedback levels, $F_C$(fo), are in response to the stimulus set of comfortable but slightly soft levels, C($f_o$).

By way of illustration, a 4000-Hz stimulus with a level producing comfortable but slightly soft loudness is shown in FIG. 8 at position 61. Position 61 is equivalent to the level S(f'o) in the above equation, where $f'_o$=4000 Hz. This stimulus will cause a feedback signal at the microphone with frequency of 4000 Hz at the level shown at position 62, $F_S(f'_i)$. This input signal will then be amplified and optionally shifted in frequency. In this example, a downward shift of one octave produces an output signal with frequency $f'_o$=2000 Hz, and the level shown at position 63, $[F_S(f'_i)+H(f'_i)]$. From the difference in dB between position 63, the threshold level, D(f'o)−[$F_S$(f'i)+H(f'i)], and the level of the original stimulus, it is possible to calculate the activation level. This is the maximum level that limits the feedback signal to below the threshold of hearing, position 64.

The foregoing is a specific example of the more general case in which the activation levels for feedback suppression in an audio amplification apparatus are determined from listener disturbance threshold levels, amplification and feedback path transfer function. In the example of an audio amplification apparatus using frequency transposition as a means of feedback suppression, the activation levels A(f) can be determined by the following:

$$|A(f)|=|D(f')|-|H(f)|-|G(f)|$$

where D(f) are the listener disturbance threshold levels at which a disturbance is detected by a listener. As an example, the listener disturbance threshold levels may be the hearing threshold levels of a listener. It will be appreciated from the foregoing that where the forward transfer path of the audio amplification apparatus includes a frequency transposing element, the activation level at each frequency will be determined from the amplification and feedback path transfer function at that frequency and from the disturbance threshold level at a transposed frequency. However, where the forward transfer path does not include a frequency transposing element, the activation level at each frequency will be determined from the amplification, feedback path transfer function and disturbance threshold level at that frequency.

Referring once again to FIG. 5, the stimulus generator 41 can be used to generate a set of output stimuli, which can be used to directly calculate the feedback path transfer function by measuring and recording output transducer signal components and feedback signal components at various frequencies. A suitable set of stimuli may be the set of comfortable but slightly soft equal loudness levels, but other sets of stimuli may equally be used. The characteristics of the feedback path change with disturbances to the sound field around the ear and head. It is therefore possible to construct several different feedback path situations which reflect typical changes in the feedback path that may be expected during every day use of the hearing aid.

Assuming an external signal is not provided to the audio amplification apparatus shown in FIG. 5, we can therefore calculate the feedback path transfer function from the following:

$$|G(f)|=|F_o(f)|-|O(f)|$$

In this way, the feedback path transfer function G(f) at each frequency is determined by presenting stimuli to the receiver at various frequencies, recording output transducer signal components O(f) and feedback signal components $F_o(f)$ resulting from those stimuli, and deriving the feedback path transfer function at each frequency from the transducer output signal components O(f) and the feedback signal components $F_o(f)$.

The feedback path transfer function may also be estimated by detecting the onset of feedback oscillation in a conventional, non-shifting audio amplification apparatus, as shown in FIG. 1. Without the use of any external apparatus, the amplification at each frequency can be adjusted, and the feedback path transfer function at that frequency derived from the lowest amplification at which feedback oscillation is detected. This onset indicates that the magnitude of the feedback path and the magnitude of the amplification are equal in units of dB, and also that the phase of the loop gain is a whole multiple of 360°. Typically, the onset of feedback oscillation is heard by an audiologist but may also be measured at the output transducer. Once the feedback path transfer function has been estimated, the activation levels may be derived, as described above.

It will be appreciated that the above general method of determining activation levels for a feedback suppressor during fitting of a hearing aid to each user is also applicable when no frequency shifting is applied.

The above-described embodiment of the sound processor 10 may be implemented by digital signal processing techniques, using processing means to perform the various computations and control the operation of the various other elements of the sound processor 10. It will be appreciated that although a substantially digital implementation of the sound processing device and method has been described above, some or all of the elements or processing stages may be implemented using other techniques, such as by use of analogue electronic circuits. For example, the oscillators may be implemented using appropriate analogue circuits, resulting in a reduction in the electrical power requirements of the processing system, and therefore providing benefits for a practical implementation in a wearable hearing aid.

Many other variations may be made to the above described method and device for processing sound signals without departing from the spirit or ambit of the invention. For example, although no detailed implementation has been described, the present invention may have application to areas of sound processing other than hearing aids.

The claims defining the invention are as follows:

1. A method of adjusting frequency-dependent amplification in an audio amplification apparatus, the audio amplification apparatus including:

a forward transfer path connectable to an output transducer, the forward transfer path including a frequency transposing element; the method including the steps of:

presenting stimuli to the output transducer at a plurality of frequencies;

adjusting the stimulus level at each frequency to meet a predefined loudness perception level or detection threshold of the listener;

deriving an equal loudness contour of output transducer levels from the adjusted stimuli levels; and deriving the frequency-dependent amplification of levels of input signals at each frequency from the equal loudness contour at the corresponding transposed frequencies.

2. A method according to claim 1, wherein the frequency-dependent amplification at each frequency is derived by subtracting the magnitude of a standardised input signal component at that frequency from the magnitude of the stimulus level at a transposed frequency.

3. A method according to claim 2, wherein the magnitude of the input signal component at each frequency is the level of international long-term average speech spectrum (ILTASS) at an overall level of 70 dB SPL at that frequency.

4. A method according to claim 1, wherein the stimuli are applied directly to the output transducer.

5. A method according to claim 1, wherein the predefined loudness perception level of the listener is selected from the group of: very soft, soft, comfortable but slightly soft, comfortable, comfortable but slightly loud, loud but OK, uncomfortably loud and extremely uncomfortable.

6. A method according to claim 5, wherein the predefined loudness perception level of the listener is comfortable but slightly soft.

7. A method according to claim 1, wherein the predefined loudness perception level of the listener is determined by:

the listener choosing a descriptor of the stimulus level at each frequency; and adjusting the stimulus level until the chosen descriptor meets the predefined loudness perception level of the listener.

8. A method according to claim 1, wherein the predefined loudness perception level of the listener is determined by:

presenting a reference stimulus to the output transducer at one of the plurality of frequencies, the stimulus level meeting the predefined loudness perception level of the listener;

presenting stimuli to the output transducer at the other frequencies; and adjusting the stimulus level at the other frequencies to match the listener's loudness perception level to that of the reference stimulus.

9. A signal processing device for use in an audio amplification apparatus, the device acting to receive digitised sound signals and generate output transducer signals, the sound processing device including:

processing means for use in performing a method according to claim 1.

10. A signal processing device according to claim 9, wherein the processing means is implemented in digital signal processing (DSP) technology.

11. A method of adjusting frequency-dependent amplification in an audio amplification apparatus, the audio amplification apparatus including:

a forward transfer path connectable to an output transducer, the forward transfer path including a frequency transposing element; and a feedback path adding a feedback signal to the forward transfer path, the feedback path being disconnected from the forward transfer path during fitting; the method including the steps of:

applying a standardised input signal to the forward transfer path so as to apply stimuli to the output transducer at a plurality of frequencies; and adjusting the frequency-dependent amplification at each frequency so that the stimulus level meets a predefined loudness perception level or detection threshold of the listener.

12. A method according to claim 11, wherein the magnitude of the input signal component at each frequency is the level of international long-term average speech spectrum (ILTASS) at an overall level of 70 dB SPL at that frequency.

13. A method according to claim 11, wherein the predefined loudness perception level of the listener is selected from the group of: very soft, soft, comfortable but slightly soft, comfortable, comfortable but slightly loud, loud but OK, uncomfortably loud and extremely uncomfortable.

14. A method according to claim 13, wherein the predefined loudness perception level of the listener is comfortable but slightly soft.

15. A method according to claim 11, wherein the predefined loudness perception level of the listener is determined by:

the listener choosing a descriptor of the stimulus level at each frequency; and adjusting the stimulus level until the chosen descriptor meets the predefined loudness perception level of the listener.

16. A method according to claim 11, wherein the predefined loudness perception level of the listener is determined by:

presenting a reference stimulus to the output transducer at one of the plurality of frequencies, the stimulus level meeting the predefined loudness perception level of the listener;

presenting stimuli to the output transducer at the other frequencies; and adjusting the stimulus level at the other frequencies to match the listener's loudness perception level to that of the reference stimulus.

17. A method of determining activation levels for feedback suppression in an audio amplification apparatus, the audio amplification apparatus including:

a forward transfer path connectable to an output transducer;

a feedback path adding a feedback signal to the forward transfer path; and feedback suppression means for selectively compensating for the presence of an undesired feedback signal component when a signal output level is greater than a predetermined activation level; the method including the steps of:

determining a listener disturbance threshold level D at each frequency;

determining the amplification H at each frequency;

determining feedback path transfer function G at each frequency; and determining the activation level A at each frequency from the disturbance threshold levels, amplifications and feedback path gains according to:

$$|A|=|D|-|H|-|G|.$$

18. A method according to claim 17, wherein the disturbance threshold level is a hearing threshold level.

19. A method according to claim 17, wherein the forward transfer path is disconnected from the output transducer during fitting, and wherein the feedback path transfer function G at each frequency is determined by:

presenting stimuli to the output transducer at a plurality of frequencies;

recording output transducer signal components and feedback signal components at the plurality of frequencies; and deriving the feedback path transfer function G at each frequency from the output transducer signal components and feedback signal components.

20. A method according to claim 17, wherein the feedback path transfer function G at each frequency is determined by:

adjusting the amplification at each frequency;

deriving the feedback path transfer function G at that frequency from the lowest amplification at which feedback oscillation is detected.

21. A method according to claim 17, wherein the forward transfer path includes a frequency transposing element, and wherein the activation level A at each frequency is determined from the amplification and feedback path gain at that frequency and from the disturbance threshold level at a transposed frequency.

22. A method according to claim 17, wherein the forward transfer path is disconnected from the output transducer during fitting, the method further including the steps of:

presenting stimuli to the output transducer at a plurality of frequencies;

adjusting the stimulus level at each frequency to meet a predefined loudness perception level or detection threshold of the listener; measuring feedback signal components resulting from the stimuli at the plurality of frequencies;

determining the amplification at the plurality of frequencies from the stimuli and standardised input signal components; and determining the activation level at each frequency from the levels of stimuli, feedback signal components, disturbance threshold levels and amplifications.

23. A method according to claim 22, wherein the activation level As at each frequency is determined according to:

$$AS=S+\{D-[Fs+H]\}$$

where at each frequency, S is the magnitude of the stimulus, D is the listener's hearing threshold level, $F_S$ is the feedback signal component resulting from the stimulus and H is the amplification.

24. A method according to claim 23, wherein the forward transfer path includes a frequency transposing element, and wherein the activation level As at each frequency is determined from S, $F_S$ and H at that frequency and D at a transposed frequency.

25. A method of fitting an audio amplification apparatus, the audio amplification apparatus comprising a forward transfer path connectable to an output transducer, the forward transfer path including a frequency transposing element; a feedback path adding a feedback signal to the forward transfer path; and feedback suppression means for selectively compensating for the presence of an undesired feedback signal component when a signal output level is greater than a predetermined activation level, the method comprising the steps of:

adjusting frequency-dependent amplification in the audio amplification apparatus by presenting stimuli to the output transducer at a plurality of frequencies; adjusting the stimulus level at each frequency to met a predefined loudness perception level or detection threshold of the listener; deriving an equal loudness contour of output transducer levels from the adjusted stimuli levels; and deriving the frequency-dependent amplification of levels of input signals at each frequency; and determining activation levels for feedback suppression in the audio amplification apparatus by: determining a listener disturbance threshold level D at each frequency; determining the amplification H at each frequency; determining feedback path transfer function G at each frequency; and determining the activation level A at each frequency from the disturbance threshold levels, amplifications and feedback path gains according to:

$$|A|=|D|-|H|-|G|.$$

* * * * *